US005490669A

United States Patent [19]

Smart

[11] Patent Number: 5,490,669

[45] Date of Patent: Feb. 13, 1996

[54] LAMINATED BALL BAT

[76] Inventor: Merlin L. Smart, 134 Zimmerman Rd., Kalispell, Mont. 59901

[21] Appl. No.: 326,475

[22] Filed: Oct. 20, 1994

Related U.S. Application Data

[63] Continuation of Ser. No. 222,163, Apr. 4, 1994, Pat. No. 5,388,363, which is a continuation of Ser. No. 959,434, Oct. 13, 1992, abandoned.

[51] Int. Cl.[6] ..... A63B 59/06

[52] U.S. Cl. ..... 273/72 R; 273/72 A; 273/266; 273/81 B

[58] Field of Search ..... 273/72 R, 67 A, 273/81 R, 67 DA; 42/71.01, 75.03

[56] References Cited

U.S. PATENT DOCUMENTS

| | | | |
|---|---|---|---|
| D. 241,836 | 10/1976 | Ruger et al. . | |
| 458,824 | 9/1891 | Daudeteau . | |
| 557,947 | 4/1896 | Bennett . | |
| 1,025,529 | 5/1912 | Johnson . | |
| 1,025,550 | 5/1912 | Tilton . | |
| 1,376,917 | 5/1921 | Bump . | |
| 1,725,605 | 5/1926 | Upton | 42/71.01 |
| 2,563,923 | 8/1951 | Crosby . | |
| 2,944,820 | 7/1960 | Paullus | 273/72 R |
| 3,023,527 | 3/1962 | Leek et al. . | |
| 5,088,733 | 2/1992 | Barnea et al. | 273/72 R |

FOREIGN PATENT DOCUMENTS

| | | |
|---|---|---|
| 923976 | 7/1947 | France . |
| 925197 | 8/1947 | France . |

OTHER PUBLICATIONS

*RIFLE—The Sporting Firearms Journal*—Sep./Oct., 1990, #131, pp. 55–56.

*Primary Examiner*—Vincent Millin
*Assistant Examiner*—Charles W. Anderson
*Attorney, Agent, or Firm*—Wood, Phillips, VanSanten, Clark & Mortimer

[57] ABSTRACT

A laminated ball bat is provided having a handle end and a barrel end. The laminated ball bat includes first and second laminae cut from an elongate wood block. The elongate wood block has first and second spaced ends with the ends spaced lengthwise of the elongate wood block and has grain running lengthwise between the first and second ends. The first and second laminae each have first and second ends corresponding to the first and second ends of the elongate wood block and have at least one curved growth ring portion opening in a direction transverse to a line extending between the first and second ends of each of the first and second laminae. The first and second laminae are oriented in the ball bat so that the growth ring portions of the first lamina are the substantial mirror image of the growth ring portions of the second lamina and the first ends of the first and second laminae are at the barrel end of the ball bat and the second ends of the first and second laminae are at the handle end of the ball bat.

11 Claims, 2 Drawing Sheets

12
10
18
14
26
33
32
16
58
62
24
15
22
68
64
20
28
42
30
38
40
36
34
70
60
4
66
44
46
48
50
52
54
4
30
64
30
30
70
68
54
44
46
66
48
50
52
70
68
56
44
46
48
50
52
54

LAMINATED BALL BAT

CROSS REFERENCE

This application is a continuation of my application Ser. No. 08/222,163, filed Apr. 4, 1994, now U.S. Pat. No. 5,388,363, entitled "Laminated Gun Stock", which is a file wrapper continuation of Ser. No. 7/959,434, filed Oct. 13, 1992, now abandoned.

FIELD OF THE INVENTION

This invention relates to ball bats and, more particularly, to a laminated ball bat.

BACKGROUND OF THE INVENTION

As high grade woods used in making conventional wooden bats become more scarce, the raw material cost for such bats accordingly increases. When lower grade woods are used to make bats, the chances of bat breakage are increased, increasing user costs. In addition, lower grade woods generally are not as resilient as higher grade woods. Therefore, a ball will travel farther in the air when hit with a conventional bat made from higher grades of wood. As such, there is a need to find a compromise between the use of inexpensive wood raw materials, i.e., low grade woods, while maintaining the high resiliency characteristics of high grade woods used in making conventional bats.

Another problem is the potential for injury caused by such bat breakages. While baseball is a relatively injury-free sport due to its non-contact nature versus other major sports in this country, i.e., football and basketball, there is still a risk of injury to both fans and players from bat breakage which can occur when a bat contacts a ball. When such breakage occurs, the handle of the bat is left in the player's grip while the remaining portion of the bat with sharp portions of exposed wood is sent dangerously whirling through the air. This broken portion of the bat sent through the air can cause serious injuries to both fans and players. In fact, there have been occasions where such broken portion of the bat has impaled a batter awaiting his turn at the plate in the on-deck circle which is in relatively close proximity to the batter's box. This is of particular concern in games played at levels below the major league level, e.g., little league, high school, college and minor league levels, where oftentimes fans can also be in relatively close proximity to the batter with no protection from such injury due to bat breakage.

Baseball is a relatively low scoring and slow paced game when compared to football and basketball. However, it is generally agreed that the most exciting offensive occurrence in a baseball game is when a batter strikes a pitched ball with such force and at the right point on the bat that it is sent through the air into the stands or out of the park for a home run. Thus, batters have great incentive to find ways to increase their likelihood of hitting home runs. While this act requires a great deal of skill on the player's part, as mentioned earlier, the fight bat can also improve the player's chances of hitting a home run. In an effort to improve the performance of bats made from even high grades of wood in terms of the distance a ball travels through the air, players oftentimes have their bats "corked". Corking of a bat involves drilling out a portion of the barrel section of the bat and inserting a cork piece into the hollowed-out portion of the barrel of the bat. Subsequently, a wood plug is used to cover the hollowed-out portion with the plug being matched to the grain at the end of the barrel so that any evidence of tampering with the integrity of the bat is minimized. Although theories as to why corking improves ball travel when hit by a corked bat vary, it is generally agreed that a corked bat is lighter than a normal bat, thus improving the bat speed of a player, which generally will translate into increased ball travel upon contact with the bat. Such corking is prohibited in major league baseball. Hence, there is a need to provide more easily observable evidence of corking in baseball bats.

In addition, it is known that in a normal ball bat, the point of greatest strength, and thus maximum resiliency for increased ball travel, is at the edge grain of the bat. Thus, bat manufacturers generally imprint their manufacturing label so that the center thereof is substantially on the flat grain of the bat so that batters are alerted to position the label to align the edge grain of the bat with the point of contact of the ball on the bat. By contacting the ball at the edge grain of the bat, the frequency of bat breakage is also reduced.

SUMMARY OF THE INVENTION

The present invention is specifically directed to overcoming the above enumerated problems in a novel and simple manner.

According to the invention, a laminated ball bat is provided having a handle end and a barrel end. The laminated ball bat includes first and second laminae cut from an elongate wood block. The elongate wood block has first and second spaced ends with the ends spaced lengthwise of the elongate wood block and has grain running lengthwise between the first and second ends. The first and second laminae each have first and second ends corresponding to the first and second ends of the elongate wood block and have at least one curved growth ring portion opening in a direction transverse to a line extending between the first and second ends of each of the first and second laminae. The first and second laminae are oriented in the ball bat so that the growth ring portions of the first lamina are the substantial mirror image of the growth ring portions of the second lamina and the first ends of the first and second laminae are at the barrel end of the ball bat and the second ends of the first and second laminae are at the handle end of the ball bat.

The laminated ball bat is provided with material for joining the first and second laminae together in the ball bat between the first and second laminae to form a first pair of laminae which abut one another and have substantial mirror image growth ring portions.

The first and second laminae each have opposing side faces extending between the first and second ends of the first and second laminae such that the first and second laminae adjoin each other at side faces thereof as part of the wood block and a side face of the first lamina which adjoins a side face of the second lamina as part of the wood block is joined by the joining material to a side face of the second lamina which did not adjoin the first lamina as part of the wood block.

The laminated ball bat can include a lamina having neutral grain between the first and second laminae.

The laminated ball bat can further include third and fourth laminae cut from the elongate wood block similar to the first and second laminae, with the third and fourth laminae oriented in the ball bat so that the growth ring portions are substantially mirror images of each other and the first ends of the third and fourth laminae are at the barrel end of the bat and the second ends of the third and fourth laminae are at the handle end of the bat. The third and fourth laminae are joined by the joining material together in the ball bat to form a second pair of laminae abutting one another and having substantially mirror image growth ring portions.

The laminated ball bat can include indicia on the ball bat for indicating the proper orientation of the bat for maximum resiliency of the bat when contacted with a ball.

Another aspect of the invention is to provide an elongate laminated wood blank for forming a laminated ball bat. The laminated wood block includes first and second laminae cut from an elongate wood block, with the elongate wood block having first and second spaced ends spaced lengthwise of the elongate wood block and grain running lengthwise between the first and second ends. The first and second laminae each have first and second ends corresponding to the first and second ends of the elongate wood block, and at least one curved growth ring portion opening in a direction transverse to a line extending between the first and second ends of each of the first and second laminae. The first and second laminae in the elongate laminated wood blank are oriented so that the growth ring portions are substantially mirror images of each other and the elongated laminated wood blank has grain running lengthwise between the first and second ends of the first and second laminae.

The first and second laminae each have opposing side faces and edge faces extending between the first and second ends of the first and second laminae such that cutting the laminae from the elongate wood blank produces laminae having exposed edge grain on the opposed edge faces and exposed flat grain on the opposed side faces.

Another feature of the invention is to provide a laminated ball bat having a generally circular cross-sectional area transverse to the line extending between the first and second ends of the laminae. The substantial mirror image growth ring portions of the laminated ball bat provide ready visual indication of tampering with the laminated bat. The grain at a first point on the circumference of the laminated ball bat is substantially the same as the grain at a second point on the bat spaced 180° from the first point. The indicia for indicating the proper orientation of the bat includes a label which is centered on substantially flat grain of the bat.

In another aspect of the invention, a method of making a laminated wood blank is shown including the steps of providing an elongate wood block having first and second spaced ends lengthwise of the block and grain running lengthwise between the first and second ends. First and second laminae are cut from the wood block with the laminae each having first and second ends corresponding to the first and second ends of the elongate wood block and at least one curved growth ring portion opening in a direction transverse to a line extending between the first and second ends of the first and second laminae. The first laminae is rotated about its longitudinal axis with respect to the second laminae and the rotated first laminae is joined to the second laminae such that the laminae each have substantially the same end-to-end alignment as the laminae had as part of the wood block from which the laminae were cut and the growth ting portions on the first lamina substantially mirror growth ring portions on the second lamina. Another feature of the method includes the step of forming a laminated ball bat from the laminated wood blank.

DETAILED DESCRIPTION OF PREFERRED EMBODIMENTS

Figures 1, 2, 3, 4, 5:
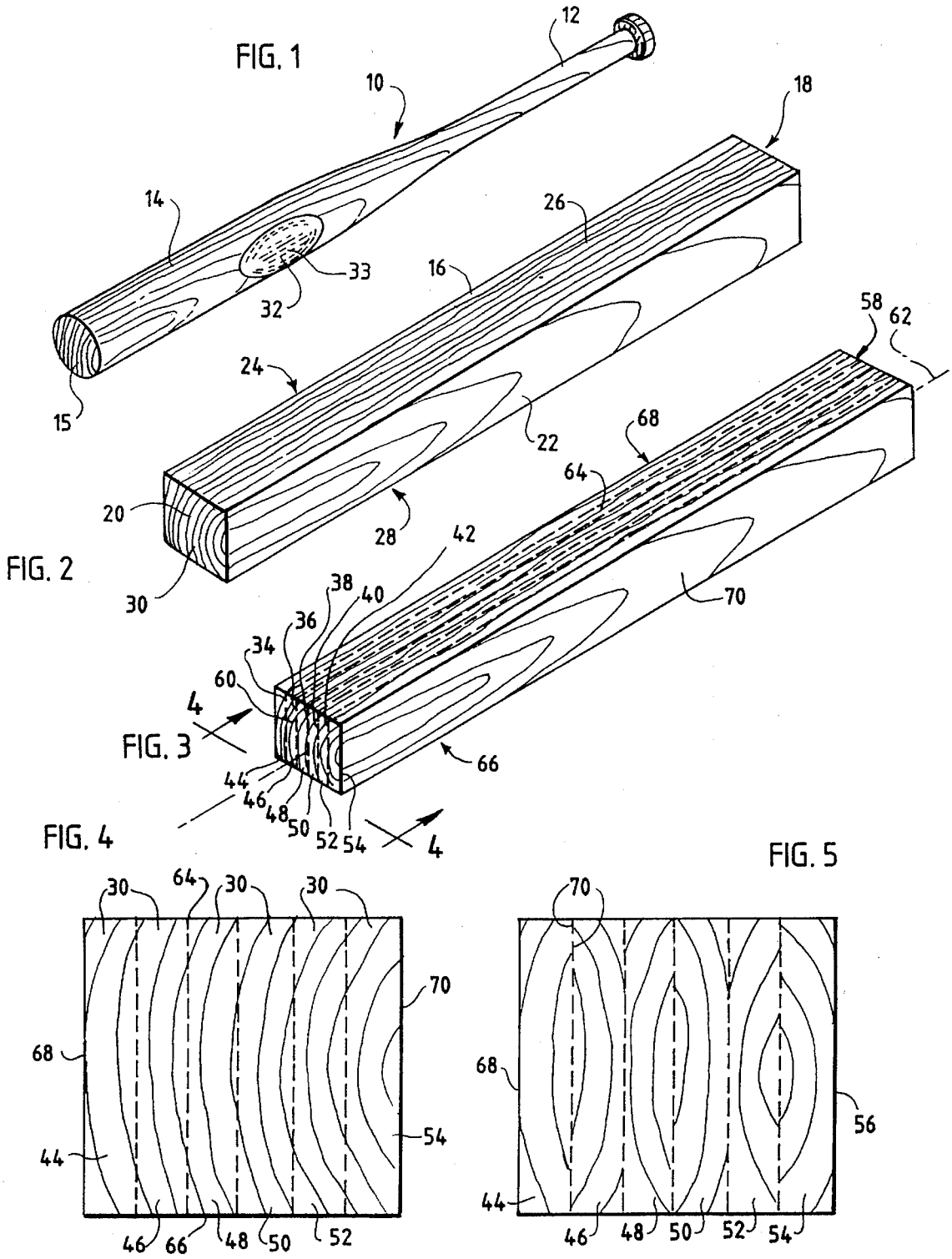
FIG. 1 is a perspective view of a wood ball bat according to the prior art.
FIG. 2 is a perspective view of an elongate wood block from which a ball bat might be cut.
FIG. 3 is a perspective view of the wood block of FIG. 2 with cut lines for laminae that are cut from the wood block.
FIG. 4 is an end view taken along line 4—4 of FIG. 3.
FIG. 5 is an end view, similar to FIG. 4, of a six-layer laminated wood blank for forming a laminated ball bat according to the invention.

In FIG. 1, a conventional wood ball bat 10 is shown having a handle end 12 and a barrel end 14. The conventional wood ball bat 10 is made from a single piece of wood and is cut from an elongate wood block 16, as seen in FIG. 2.

The elongate wood block 16 has first and second spaced ends, 18 and 20, which are spaced lengthwise of the elongate wood block 16 with grain running lengthwise between the first and second ends, 18 and 20. The elongate wood block 16 has rectangular opposing side faces, 22 and 24, and rectangular opposing edge faces, 26 and 28, with both the opposing side faces, 22 and 24, and the opposing edge faces, 26 and 28, extending between the spaced ends, 18 and 20, of the elongate wood block 16.

As can be seen in FIG. 2, the elongate wood block generally 16 has generally concentric growth ring portions 30 exposed at end faces, 18 and 20. While the grain of a piece of wood such as the elongate wood block 16 will extend in one direction, the grain will be of basically two different types of grain running in this direction, flat grain and edge grain. In the elongate wood block 16, the opposing side faces 22 and 24 have exposed flat grain while the opposing edge faces 18 and 20 have exposed edge grain. Maximum resiliency strength of wood occurs in a direction normal to the edge grain thereof.

Hence, when a conventional ball bat 10 is formed from an elongate wood block such as 16, the grain along the length of the bat will be composed of substantially edge grain, substantially flat grain, and a grain being a combination of both due to the circular cross-sectional configuration of the bat 10. It also will be apparent that the grain at a first point on the bat 10 will generally be the same as the grain at a second point on the bat spaced 180° from the first point.

For maximum ball flight, it is desirable for the batter to orient the bat 10 such that the portion of the bat 10 having substantially exposed edge grain contacts the ball when the bat 10 is swung. Conversely, it is also desirable that the batter not contact the portion of the bat 10 having substantially exposed flat grain thereon with the ball, as otherwise the ball may not travel as far as it would had it been hit with the portion of the bat 10 having exposed edge grain, and the bat 10 is more likely to break. Therefore, baseball bats are provided with means for indicating the proper orientation of the bat for maximum resiliency of the bat when contacted with the ball in the form of a label 32 having a center 33 thereof which is imprinted on the portion of the bat 10 having substantially exposed flat grain. The label 32 generally is imprinted at or near the barrel end 14 of the bat 10, as seen in FIG. 1.

A player holding a bat 10 can assure that the bat 10 will contact the ball, if properly hit, at the part of the bat 10 having substantially exposed flat grain by having the label 32 facing the player such that the edge grain on the bat 10 will generally be 90° displaced from the center 33 of the label 32.

To reduce the risk of inadvertent breakage of the bat 10 and to improve the resiliency and therefore the distance a ball can be hit, the elongate wood block 16 is cut lengthwise along dotted lines 34, 36, 38, 40 and 42, creating six laminae 44, 46, 48, 50, 52 and 54 having generally the same geometric configuration, i.e., a rectangular parallelepiped as seen in FIG. 3. As such, each lamina will have end surfaces 58 and 60, opposing edge faces, 64 and 66, and opposing side faces, 68 and 70, with the opposing edge faces, 64 and 66, and opposing side faces, 68 and 70, extending between the end surfaces 58 and 60. The laminae ends, 58 and 60, correspond to the ends, 18 and 20, respectively, of the elongate wood block 16.

Although six laminae having equal dimensions are shown, both the number and the thickness of the laminae (i.e., the distance across the end surfaces 58 and 60) can vary. If the laminae vary in thickness, it is generally desirable to have thicker outer laminae.

FIG. 4 is a two-dimensional view of the laminae 44, 46, 48, 50, 52 and 54 as viewed from their ends 60. When cut from the elongate wood block 16 the laminae 44, 46, 48, 50, 52 and 54 each have at least one curved growth ring portion 30 opening in a direction transverse to a longitudinal axis 62 of the elongate wood block 16. The longitudinal axis 62 extends between the first and second ends, 18 and 20, of the elongate wood block 16 and therefore between the first and second ends 58 and 60 of the laminae 44, 46, 48, 50, 52 and 54.

Figure 6:
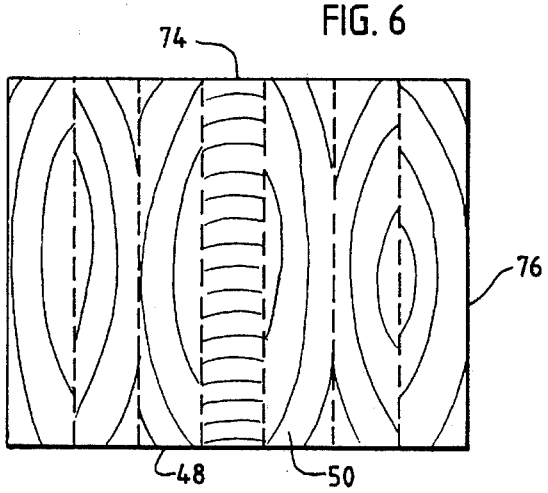
FIG. 6 is an end view, similar to FIG. 5, of a seven-layer laminated wood blank.

FIG. 5 shows the laminae 44, 46, 48, 50, 52 and 54 arranged in a laminated wood blank 56. Means are provided for joining the laminae 46, 50 and 54 to the laminae 44, 48 and 52, respectively, in the form of any suitable wood bonding adhesive. Before bonding the laminae together, the laminae 46, 50 and 54 are rotated 180° about their respective longitudinal axes. Then, the adhesive is utilized to bond, for example, lamina 46 at its side face 70 to the side face 70 of lamina 44 so that the pair of laminae 44 and 46 are bonded together at their respective side faces 70 which did not adjoin each other as part of the wood block 16. Lamina pairs 48 and 50 and 52 and 54 are bonded together in a similar manner. Finally, the pairs of laminae are bonded to each other to form the laminated wood blank 56. As a result, the growth ring portions in the pairs of laminae, such as laminae 44 and 46, are the substantial mirror image of each other. In addition, a laminae 74 which may be cut from a different wood block having neutral grains, as seen in FIG. 6, can be bonded centrally in a laminated blank 76 between a laminae pair, such as 48 and 50, to form the laminated elongate wood blank 76.

Figure 7:
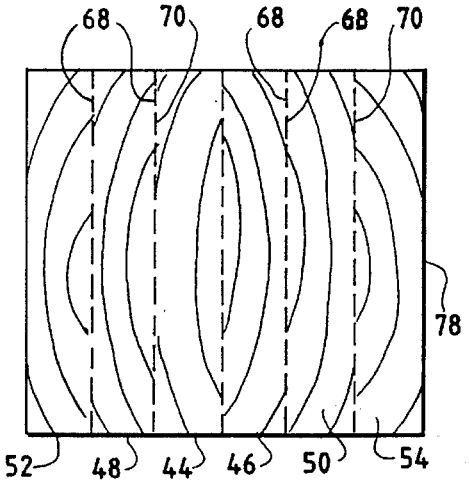
FIG. 7 is an end view, similar to FIG. 5, of another embodiment of a six-layer laminated wood blank having a modified mirror-image construction according to the invention.

Alternatively, the mirror imaging of the growth ring portions 30 can occur in a slightly modified form as seen in FIG. 7. In this form, laminae 44 and 46 are adjoining each other in the laminated wood blank 78, with the lamina 48 being bonded at its side face 70 to the side face 68 of lamina 44 with lamina 50 being bonded at its side face 68 to the side face 68 of lamina 46. Likewise, laminae 52 and 54 are bonded to outer oppositely directed side faces, 68 and 70, respectively, of laminae 48 and 50.

As a result of the construction of the laminated wood blanks by rotation of laminae 180°, the grain of the laminated wood blank will run in the same direction as the gram of the elongate wood block 16 and the edge gram will still be exposed at the edge faces 64 and 66 of the laminae and the flat gram will be exposed at the outermost side faces 68 and 70 of the elongate laminated wood blanks 56, 76 and 78.

A laminated wood ball bat 80 can be formed from the laminated wood blocks with the result that the laminated bat 80 will show substantial increases in the strength and resiliency due to the laminated construction with mirror image growth ring portions 30. This provides the laminated bat 80 with improved resistance to breakage when contacted with a ball and aim improves the distance a ball can be hit due to the increased resiliency of the bat 80. Another benefit is that lower grade woods can be used to produce the laminated wood blanks 56, 76 and 78 while still improving upon the strength and resiliency characteristics over conventional wood bats 10 made from higher grades of wood. This is particularly important as high quality wood becomes more and more of a scarce commodity.

Figure 8:
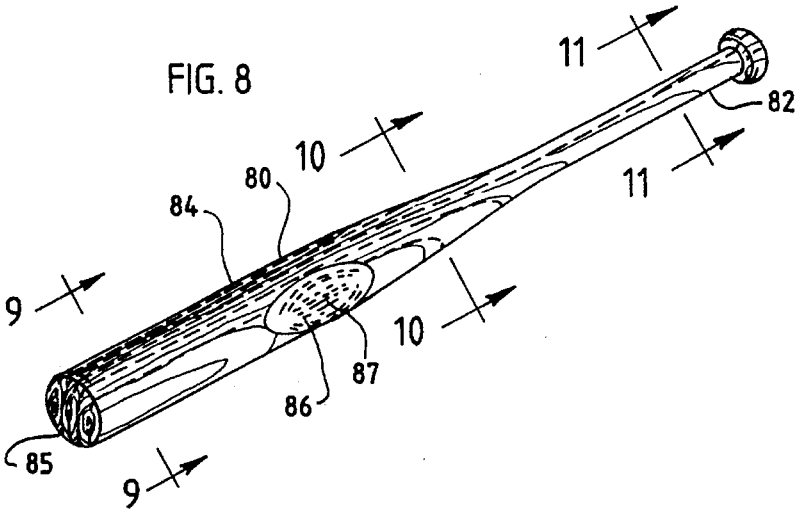
FIG. 8 is a perspective view of a laminated ball bat.
Figure 9:
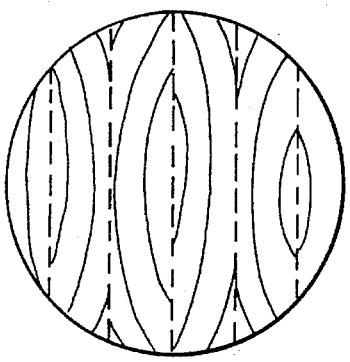
FIG. 9 is a cross-sectional view taken along line 9—9 of FIG. 8.
Figure 10:
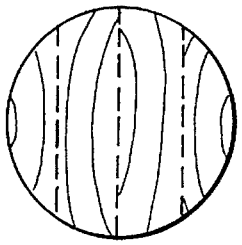
FIG. 10 is a cross-sectional view taken along line 10—10 of FIG. 8.
Figure 11:
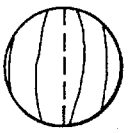
FIG. 11 is a cross-sectional view taken along line 11—11 of FIG. 8.

The laminated ball bat 80 is formed, similar to a conventional bat 10, such that it has a generally circular cross-sectional area transverse to the length of the bat 80 between a handle end 82 and a barrel end 84 of the laminated wood bat 80 with this area varying in diameter along the bat length, as shown in the cross-sectional views of FIGS. 9–11 taken at various points along the length of the laminated bat 80 shown in FIG. 8. Because of the circular cross-section of the bat 80 as taken from the laminated blanks, the grain at the surface of the bat 80 will generally consist of substantially edge grain, substantially flat grain and a grain which is a combination of edge grain and flat grain with the grain on the bat 80 varying from substantially all flat grain to an equal mix of flat grain and edge grain to substantially all edge grain at approximately 45° intervals along the circumference of the bat 80. Nevertheless, the grain will be similarly composed of one of substantially edge grain, substantially flat grain and a grain being a combination of edge and flat grain at a first point on the bat 80 and a second point on the bat 80, with the second point being spaced 180° from the first point.

Due to the laminated, mirror image construction, the bat 80 has almost equal strength around the entire circumference of the surface of the bat 80. Unlike conventional bats 10 where the strongest point on the bat 10, or the "sweet spot" where the ball should be hit, is at the edge grain because of the substantial difference in strength between the edge grain and flat grain of the bat 10, the laminated bat 80 can be effectively used to hit a ball at any point thereon. While the edge grain of the laminated bat 80 will be still be the strongest point thereon, it will not be so much stronger than the surface of the bat 80 having flat grain that it must be utilized to avoid breakage and to obtain the maximum ball travel. However, because the edge grain is still the strongest point on the bat 80, a label 86 having a center 87 thereof, similar to the label 32, can be imprinted with the center 87 on substantially flat grain of the laminated wood bat 80 such that if used as the previously described label 32, i.e., facing up towards the batter, the batter will be assured that the bat 80 will contact the ball at the edge grain thereof if the ball is hit properly.

In addition, because of the mirror image construction of the laminated wood bat 80, it is difficult to cork the bat 80, particularly where the bat 80 is not painted or is painted but with paint such that growth ring portions 30 are visible on the bat 80. When the conventional wood bat 10 is corked, a hollowed-out portion is drilled in the barrel end 14 of the bat 10. A piece of cork is put in the hollowed-out portion, with a wood plug then being inserted into the hollowed-out portion flush with an end 15 of the barrel end 14 of the bat 10. The wood plug attempts to match the growth ring pattern at the end 15 of the bat 10 as closely as possible to minimize the risk of detection of tampering with the bat 10. In the laminated wood bat 80, it is impossible to match the growth ring pattern with the wood plug unless the plug itself is laminated similarly to the bat 80. As such, any tampering with the bat 80 such as by corking will generally be easily detectable by a simple examination of the end 85 of the barrel end 84 of the bat 80.

The foregoing disclosure of specific embodiments is intended to be illustrative of the broad concepts comprehended by the invention.

I claim:

1. A laminated ball bat having a handle end and a barrel end, said laminated ball bat comprising:

first and second laminae cut from an elongate wood block, the elongate wood block having a) first and second spaced ends spaced lengthwise of the elongate wood block and b) grain running lengthwise between the first and second ends, said first and second laminae each having first and second ends corresponding to the first and second ends of the elongate wood block and at least one curved growth ring portion opening in a direction transverse to a line extending between the first and second ends of each of the first and second laminae, said first and second laminae in the ball bat oriented so that the growth ring portions are substantially mirror images of each other and the first ends of the first and second laminae are at the barrel end of the ball bat and the second ends of the first and second laminae are at the handle end of the ball bat.

2. The laminated ball bat of claim 1 further comprising means for joining said first and second laminae together in the ball bat to form a first pair of laminae abutting one another having substantial mirror image growth ring portions.

3. The laminated ball bat of claim 2 wherein the first and second laminae each have opposing side faces extending between said first and second ends of the first and second laminae such that the first and second laminae adjoin each other at side faces thereof as part of the wood block and a side face of the first lamina which adjoined a side face of the second lamina as part of the wood block is joined by said joining means to a side face of the second lamina which did not adjoin said first lamina as part of said wood block.

4. The laminated ball bat of claim 2 further including third and fourth laminae cut from said elongate wood block with the third and fourth laminae each having first and second ends corresponding to the first and second ends of the elongate wood block and at least one curved growth ring portion opening in a direction transverse to a line extending between the first and second ends of each of the third and fourth laminae with said third and fourth laminae oriented in the ball bat so that the growth ring portions are substantially mirror images of each other and the first ends of the third and fourth laminae are at the barrel end of the ball bat and the second ends of the third and fourth laminae are at the handle end of the ball bat wherein said joining means joins said third and fourth together in the ball bat to form a second pair of laminae abutting one another having substantial mirror image growth ring portions.

5. The laminated ball bat of claim 1 further including a lamina having neutral grain between said first and second laminae.

6. The laminated ball bat of claim 1 further including third and fourth laminae cut from said elongate wood block with the third and fourth laminae each having first and second ends corresponding to the first and second ends of the elongate wood block and at least one curved growth ring portion opening in a direction transverse to a line extending between the first and second ends of each of the third and fourth laminae with said third and fourth laminae oriented in the ball bat so that the growth ring portions are substantially mirror images of each other and the first ends of the third and fourth laminae are at the barrel end of the ball bat and the second ends of the third and fourth laminae are at the handle end of the ball bat.

7. The laminated ball bat of claim 1 further including means on the ball bat for indicating the proper orientation of the bat for maximum resiliency of the bat when contacted with a ball.

8. A laminated ball bat having a handle end and a barrel end, said laminated ball bat comprising:

first and second laminae cut from an elongate wood block, the elongate wood block having a) first and second spaced ends spaced lengthwise of the elongate wood block and b) grain running lengthwise between the first and second ends, said first and second laminae each having first and second ends corresponding to the first and second ends of the elongate wood block and at least one curved growth ring portion opening in a direction transverse to a line extending between the first and second ends of each of the first and second laminae, said first and second laminae in the ball bat oriented so that the growth ring portions are substantially mirror images of each other and the first ends of the first and second laminae are at the barrel end of the ball bat and the second ends of the first and second laminae are at the handle end of the ball bat with grain running between the first and second ends and the ball bat having a generally circular cross-sectional area transverse to the line extending between the first and second ends of each of the first and second laminae whereby the substantial mirror image growth ring portions can provide ready visual indication of tampering with the laminated bat; and means for joining said first and second laminae in the ball bat.

9. The laminated ball bat of claim 8 wherein the first and second laminae each have opposing edge and side faces which extend between their first and second ends such that cutting the laminae from the elongate wood block produces the first and second laminae having exposed edge grain on the opposed edge faces and exposed flat grain on the opposed side faces so that grain at a first point on the ball bat is one of substantially edge grain, substantially flat grain or a grain being a combination of exposed edge and flat grain and the grain at the first point on the bat is substantially the same as the grain at a second point on the bat spaced 180 degrees around the bat from the first point.

10. The laminated ball bat of claim 8 further comprising means on the ball bat for indicating the proper orientation of the bat for maximum resiliency of the bat when contacted with a ball.

11. The laminated ball bat of claim 10 wherein said indicating means comprises indicia centered on substantially flat grain of the bat.

* * * * *